US006684779B1

(12) United States Patent
Kuhn

(10) Patent No.: US 6,684,779 B1
(45) Date of Patent: Feb. 3, 2004

(54) DEVICE FOR ADJUSTING THE DISTANCE BETWEEN TOOLS IN PRINTING MACHINERY

(75) Inventor: Federico Kuhn, St. Gallen (CH)

(73) Assignee: Gallus Ferd, Ruesch AG, Gallen (CH)

( * ) Notice: Subject to any disclaimer, the term of this patent is extended or adjusted under 35 U.S.C. 154(b) by 0 days.

(21) Appl. No.: 10/031,323

(22) PCT Filed: Jul. 6, 2000

(86) PCT No.: PCT/CH00/00374

§ 371 (c)(1),
(2), (4) Date: Apr. 17, 2002

(87) PCT Pub. No.: WO01/03928

PCT Pub. Date: Jan. 18, 2001

(30) Foreign Application Priority Data

Jul. 9, 1999 (EP) ..... 99113287

(51) Int. Cl.[7] ..... B14F 9/18
(52) U.S. Cl. ..... 101/247; 101/248; 101/218
(58) Field of Search ..... 101/248, 218, 101/116, 137, 177, 247, 220

(56) References Cited

U.S. PATENT DOCUMENTS 2,625,878 A * 1/1953 Baumgartner ..... 101/247
3,835,776 A 9/1974 Weidman
4,845,970 A * 7/1989 Schmitz ..... 72/10.1
2003/0089254 A1 * 5/2003 Reder et al. ..... 101/248

FOREIGN PATENT DOCUMENTS

| | | |
|---|---|---|
| DE | 22 08 105 | 9/1972 |
| DE | 26 09 513 | 9/1977 |
| DE | 197 43 111 | 4/1999 |
| EP | 0 196 501 | 10/1986 |

* cited by examiner

*Primary Examiner*—Andrew H. Hirshfeld
*Assistant Examiner*—Marissa Ferguson
(74) *Attorney, Agent, or Firm*—Kenyon & Kenyon

(57) ABSTRACT

A device for adjusting the distance between adjacent rotating tools, the tools arranged in lateral supports on a common base frame of a printing apparatus of which the axes extend in parallel. The distance of the tools relative to one other in their lateral supports is adjustable on a sliding rail in the base frame. The device includes a guide disposed on at least one of the lateral supports. The guide extends obliquely to the vertical direction. Also provided is an adjustably displaceable sliding element retained by the guide. The sliding element has a first and second end. A counter abutment surface is provided on at least one of the other lateral supports. The first end of the sliding element configured to contact the counter abutment surface. An adjusting drive is configured to act on the second end of the sliding element so that the sliding element acts on the counter abutment surface and adjusts the other lateral support.

6 Claims, 1 Drawing Sheet

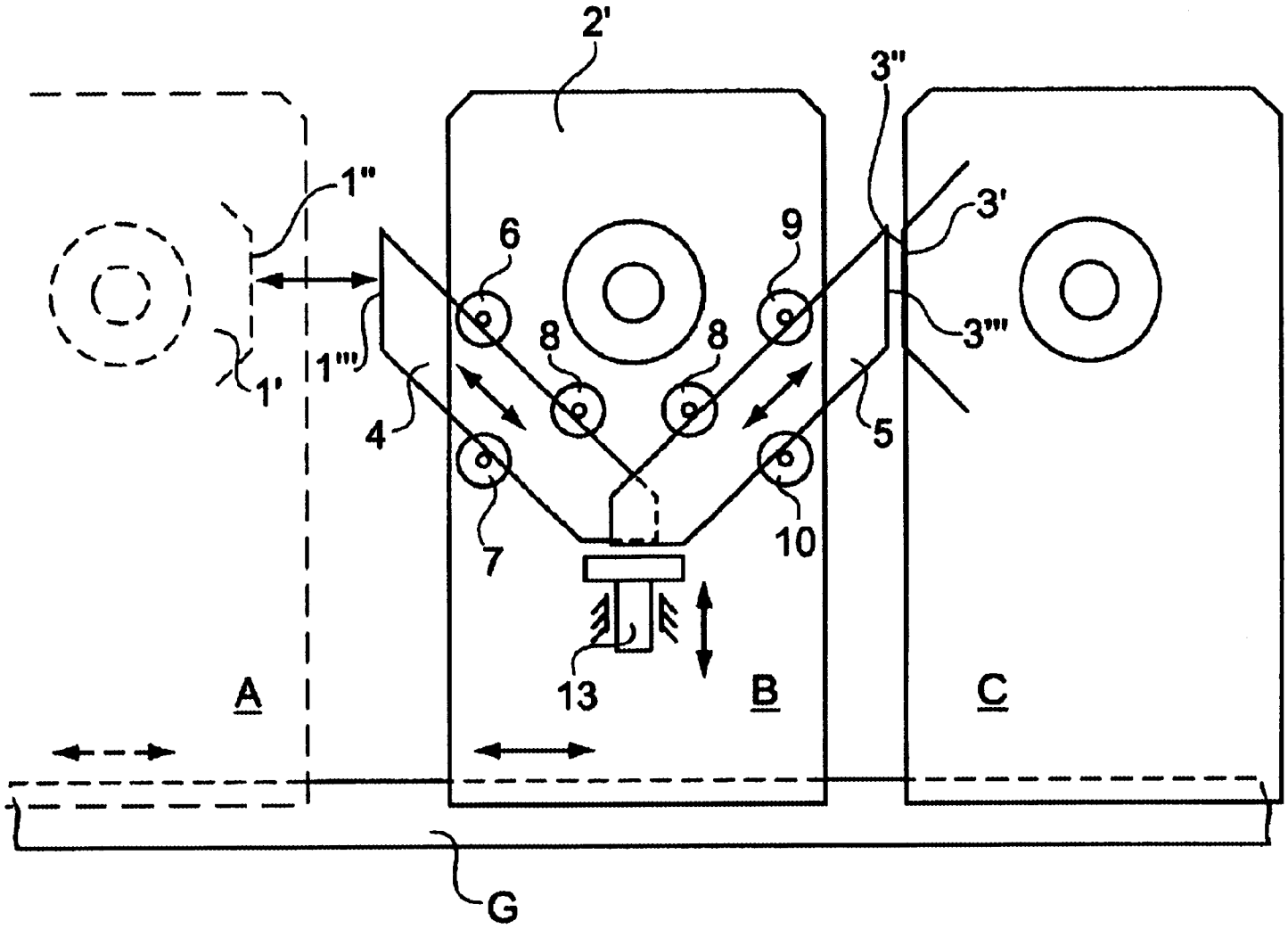
3'
3'''
3''
5
C
9
10
B
8
8
2'
13
6
7
4
1''
1'''
1'
A
G

DEVICE FOR ADJUSTING THE DISTANCE BETWEEN TOOLS IN PRINTING MACHINERY

BACKGROUND OF THE INVENTION

The present invention relates to a device for adjusting the distance between adjacent tools (having parallel axes) arranged on a common base frame of a printing unit. The invention especially relates to adjusting the distance between a form cylinder and a counter pressure cylinder and a color apparatus, in which the tools are displaceable relative to each other via a sliding guide.

It has been found to be advantageous in printing machines—particularly label printing machines—to allocate separate drives by means of a servo motor to the separate units of a printing machine such as the printing cylinder, embossing cylinder, or punching cylinder. This replaces the central drive and gear wheels (or chains or toothed belts).

Such a set-up is beneficial in that the individual components of each printing unit can be exchanged relatively quickly and easily. This allows the machine to be used in a more optimal fashion.

With regard to label printing machines, the highest demands are made on the precise position of each tool. Moreover, the simple and fast exchanging potential poses high demands on the interface of the change functions, namely the drive bearing arrangement between one end of the tools and the drive shaft of the stationary mounted servomotor.

One of the necessary adjustments is the distance between the tools of a printing unit. As a tool drives by means of servomotors this cannot proceed any longer through the conventional distance rings.

OBJECTS OF THE INVENTION

An object of the present invention is to provide a distance adjusting device that is specifically suitable for servo driven tools at printing units.

This object has been solved by a device for adjusting the distance between adjacent rotating tools, the tools arranged in lateral supports on a common base frame of a printing apparatus of which the axes extend in parallel. The distance of the tools relative to one other in their lateral supports is adjustable on a sliding rail in the base frame. The device includes a guide disposed on at least one of the lateral supports. The guide extends obliquely to the vertical direction. Also provided is an adjustably displaceable sliding element retained by the guide. The sliding element has a first and second end. A counter abutment surface is provided on at least one of the other lateral supports. The first end of the sliding element configured to contact the counter abutment surface. An adjusting drive is configured to act on the second end of the sliding element so that the sliding element acts on the counter abutment surface and adjusts the other lateral support.

With reference to the drawing, an embodiment of the invention will be explained hereinafter in more detail.

BRIEF DESCRIPTION OF THE DRAWING

A schematic illustration of a printing unit equipped with a distance adjusting device in accordance with the invention.

DETAILED DESCRIPTION OF THE INVENTION

The FIGURE schematically illustrates a base frame G of a printing unit such as a label printing device, on which tools—for example, a color apparatus A, a form cylinder B, and a counter pressure cylinder C—can be arranged at predetermined mutual distances. For reasons of an improved clarity, the tools themselves are not illustrated. Instead, only their lateral supports 1', 2', and 3' are shown (motor side) on which servomotors (not illustrated) are mounted.

In this embodiment, the tool frames with the tool supports of the color apparatus A and of the form cylinder B are displaceable relative to each other and relative to the support for the counter pressure cylinder C in order to adjust the mutual distances to the precise values.

Lateral abutment surfaces 1" and 3" are respectively disposed on both outer supports 1' and 3'. Abutment surfaces 1" and 3" have a predetermined distance from the corresponding tool axis. The supports 1' and 3' are finely adjustable such as to perform correcting adjustments during operation.

A device for setting arbitrary mutual distances to the adjacent tool is disposed at center support 2' of the tool—in this case form cylinder B. The device consists of sliding elements 4,5 that are displaceably guided in guides (recesses) of the support 2'. Covering disks 6, 7, 8, 9, 10 hold the sliding elements in place.

The upper ends of sliding elements 4, 5 comprise counter-abutment surfaces 1'" and 3'", respectively, to the abutment surfaces 1" and 3" and determine the effective distance. The sliding elements 4,5 are brought into the desired position together or individually by a driving push rod 13. When the desired distances are set, it is merely necessary to push the bottom frames of the two tools at the left side towards each other and against the one of the tool completely towards the right and to arrest them.

The distance adjusting device with the sides or sliding elements, respectively, is located preferably at both sides (pair wise) at both flanges, whereby the adjustment drive of each pair proceeds in synchronism.

By means of the distance adjusting device according to the present invention, any distance can be set, whereby the adjusting can proceed automatically by suitable electronics.

What is claimed is:

1. A device for adjusting the distance between adjacent rotating tools, the tools arranged in lateral supports on a common base frame of a printing apparatus of which the axes extend in parallel, the distance of the tools relative to one other in their lateral supports is adjustable on a sliding rail in the base frame, the device comprising:

a guide disposed on at least one of the lateral supports, the guide extending obliquely to a vertical direction;

an adjustably displaceable sliding element retained by the guide, the sliding element having a first and second end;

a counter abutment surface on at least one of the other lateral supports, the first end of the sliding element configured to contact the counter abutment surface;

an adjusting drive configured to act on the second end of the sliding element so that the sliding element acts on the counter abutment surface and adjusts the other lateral support.

2. The device according to claim 1 further comprising:

a setting device disposed on lateral supports of each tool so that both are adjusted synchronously.

3. The device according to claim 1 wherein the device is used in conjunction with three adjacently arranged tools, the device further comprising a second sliding element on the support of a central tool, each sliding element is adjustable towards an adjacent tool.

4. The device according to claim 3 wherein the sliding elements are individually adjustable at each side of the support for setting an arbitrary distance to the adjacent tool.

5. The device according to claim 3 wherein the sliding elements are arranged in a V-shaped configuration on the tool support and the adjusting drive acts onto the second ends of the sliding elements to adjust the tools.

6. The device according to claim 1 further comprising grooves in the tool support for guiding the sliding elements.

* * * * *